United States Patent [19]

Rossignol

[11] Patent Number: 5,007,584

[45] Date of Patent: Apr. 16, 1991

[54] FUEL INJECTION DEVICE

[75] Inventor: Francois Rossignol, Mornant, France

[73] Assignee: Robert Bosch GmbH, Stuttgart, Fed. Rep. of Germany

[21] Appl. No.: 424,782

[22] Filed: Oct. 20, 1989

[30] Foreign Application Priority Data

Dec. 31, 1988 [DE] Fed. Rep. of Germany ..... 3844489

[51] Int. Cl.[5] ..... F02M 57/00

[52] U.S. Cl. ..... 239/88; 239/91; 239/94; 251/30.05

[58] Field of Search ..... 239/88-94, 239/585; 251/30.02, 30.05

[56] References Cited

U.S. PATENT DOCUMENTS

| | | | |
|---|---|---|---|
| 2,279,010 | 4/1942 | Nichols | 239/92 X |
| 3,434,690 | 3/1969 | Troncale | 251/30.05 |
| 4,061,271 | 12/1977 | Kimbrongh | 251/30.05 X |
| 4,182,492 | 1/1980 | Albert et al. | 239/92 |
| 4,408,718 | 10/1983 | Wich | 239/88 |
| 4,527,737 | 7/1985 | Deckard | 239/89 |
| 4,550,875 | 11/1985 | Teermann et al. | 239/88 |
| 4,750,462 | 6/1988 | Egler et al. | 123/467 |
| 4,948,049 | 8/1990 | Brisbon et al. | 239/91 |

*Primary Examiner*—Andres Kashnikow
*Assistant Examiner*—Kevin Weldon
*Attorney, Agent, or Firm*—Edwing E. Greigg

[57] ABSTRACT

A fuel injection device having a fuel pump and an injection line connected to a pump work chamber and communicating with an injection nozzle via an interposed closing valve which closes toward the pump work chamber. Via the injection end of a magnetic control valve connected to the pump work chamber fuel can be supplied under pressure to the side of the closing valve remote from the pump work chamber and in which again via this closing valve, a connection to a return line can be opened. The actuating element of the closing valve closes toward the pump work chamber and is embodied as a differential piston including a first face which under pressure is urged in a closing direction and is larger than the effective fluid pressure surface area of a second face which urges the valve closing element in the opening direction.

20 Claims, 5 Drawing Sheets

FUEL INJECTION DEVICE

BACKGROUND OF THE INVENTION

The invention is based on a fuel injection device having a fuel pump a pump work chamber and an injection line connected to the pump work chamber. The injection line communicates with an injection nozzle via an interposed valve closing toward the pump work chamber. At the injection end and visa a control valve connected to the pump work chamber, fuel can be supplied under pressure to the side remote from the pump work chamber of the valve that closes toward the work chamber, and also via this valve, a connection to the return line can be opened up.

A device of this type is found for instance in European Patent Document Al-204 982. This fuel injection device is a so-called unit fuel injector, in which the pump piston is axially displaceable coaxially with the injection nozzle in a unit fuel injector housing. In the embodiment of Al-204 982, the shutoff of the injection event is effected in the conventional manner via control grooves on the circumference of the pump piston; via a groove provided on the pump piston, the pressure can rapidly be decreased as the piston overtakes a diversion line connected to the pump cylinder. The valve interposed between the pump work chamber and the injection nozzle is embodied as a pressure valve and is opened by the pressure in the pump work chamber, once an opening pressure predetermined by the spring of the pressure valve, whereupon the path of the fuel to the injection nozzle is opened up. In this embodiment, once the relief bore in the cylinder of the pump has been overtaken, fuel under pressure is forced into the spring chamber of a nozzle needle, which causes the closure of the nozzle needle in the direction of the spring that loads the nozzle needle. At the same time, such fuel, expelled via the diversion bore, is removed to a low-pressure line, in particular a return flow line; as a result, because of the resultant pressure drop in the pump work chamber, the pressure valve in the line to the nozzle can be closed by the force of the spring. In this known embodiment, the proposal is also made that some of this fuel diverted via the overflow line be carried into the spring chamber of the pressure valve in the line to the injection nozzle, to facilitate closure of the pressure valve. However, the actual closing stroke of the pressure valve in the known embodiment is substantially determined by the dimensions of the spring of this pressure valve, and the adaptation of this spring must be selected taking the spring characteristic of the nozzle needle spring into account, in order to assure a satisfactory function.

In fuel injection devices of the above type, especially in unit fuel injectors, it has already been proposed that instead of the diversion via control grooves of the pump piston, magnetic valves be used, to enable more precis adjustment of the instant of the end of injection by abruptly dropping the pressure.

OBJECT AND SUMMARY OF THE INVENTION

It is an object of the invention, in a fuel injection device as defined above, to further lower the inertia upon closure of the pressure valve, and particularly when pressure valves are used, to attain even more precise adjustability of the instant of the end of injection. Especially in injection at high pressure with a short injection duration, precise limitation or possible shortening of the injection duration without distortion of the injected fuel quantity is a desirable objective.

To attain this object, in the fuel injection device according to the invention, which may preferably be embodied as a unit fuel injector, the acuating element of the valve closing toward the pump work chamber is embodied as a differential piston, the face of which is urged in the closing direction is larger than the face urged in the opening direction, and the control valve is embodied as a magnetic valve. Because the actuating member of the valve closing toward the pump work chamber is embodied as a differential piston, the overflowing fluid under pressure becomes operative in the closing direction of the valve when the control valve is open for shutoff purposes; the face of the differential piston that is loaded in the closing direction must necessarily be larger than the face acted upon in the opening direction. In this kind of embodiment, the use of a spring to urge the valve in the closing direction can be dispensed with entirely, so that the delays caused by mass inertia when such a spring is used are avoided. The novel buildup of pressure or opening of the valve actuated by the differential piston is effected in a compression stroke of the pump piston, immediately following the closure of the magnetic valve, because of course at that moment the end remote from the valve of the actuating element or differential piston is acted upon only by the pressure in the return line or suction line. With the use of a differential piston instead of a spring closing the valve, valve embodiments also become possible which uncover large flow cross sections with a short valve stroke, and which, likewise with a short closing stroke, reliably close the uncovered cross section. In a preferred embodiment, the valve may be embodied with a plate-like closing element, which ca be pressed into its closing position against a flat valve seat by the differential piston. Unlike valves having a conical seat, this design enables rapid opening and closure of the valve with the shortest possible valve stroke, and hence, considering the masses to be moved, assures the shortest possible travel of the moved masses.

Particularly advantageously, the closing characteristic can be further varied, independently of the dimensioning of the nozzle needle spring itself, by providing that the differential piston comprises two pistons joined to one another via an interposed compression spring. In this kind of embodiment, the fuel flowing out of the pump work chamber under pressure via the control valve likewise acts in the direction of displacement of the larger of the two piston parts, and at the same time the interposed compression spring is put under increased pressure. The coupling of the stroke of the shorter part of the differential piston is effected here with the interposition of the spring, which should be embodied as sufficiently hard that at a low speed or low rpm it represents a virtually rigid connection with the smaller of the two piston parts. Compression of this relatively hard spring does not occur here until relatively high speed or rpm, and it ca be utilized for faster speed control by means of a faster pressure reduction, if as provided in a preferred embodiment of the invention the arrangement is such that the connecting line to the return line can be overtaken by the piston o piston part that is loadable in the closing direction, and this line is uncoverable after a predetermined stroke in the closing direction. This kind of relief bore or connecting line to the return line or suction line that can be overtaken by the larger piston or the larger piston part can be opened more quickly at high rpm if a spring is used, and in that case the spring is briefly compressed slightly. The control characteristic and in particular the precision and speed of the speed control can be still further improved by providing that the arrangement is such that the differential piston have a circumferential groove, adjoining the face urged in the closing direction, with this groove uncovering a branch line between the pump work chamber and the return line, bypassing the control valve, during the closing movement of the differential piston; in that case, in an intermediate position of the differential piston, the pump work chamber can be rapidly depressurized to pre-pump pressure or to the pressure in the return line both via the control valve and via this additional relief line. Faster relief of the pressure in the pump work chamber in this way has the effect, especially at high rpm, that the valve interposed in the injection line to the nozzle can also be closed more quickly.

Immediately after the valve seat of the valve in the injection line to the nozzle, some space must necessarily be attached, into which this valve can be displaced. Adjoining this space or chamber is the injection line to the nozzle, and the fuel that reaches the injection line when the pressure valve is open is then forced into the injection line via this space surrounding the valve. To enable still faster pressure reduction at the end of injection, particularly when a differential piston made up of two pistons adjoining one another positively in the closing direction is used, the embodiment can advantageously be such, according to the invention, that the piston or piston part oriented toward the pump work chamber has a further closing element on its end remote from the pump work chamber; when the valve is open, this further closing element closes a branch line between the injection line and the relief line of the control valve. With such an embodiment, when the pressure valve is opened for injection, a further relief bore is initially closed by the further closing element, and this further relief bore is then uncovered again quite soon, after a short stroke of the pressure valve in the closing direction; as a result, the pressure in the injection line can be reduced faster, and overall faster closure of the nozzle needle under the force of the nozzle needle spring can be effected.

The invention will be better understood and further objects and advantages thereof will become more apparent from the ensuing detailed description of preferred embodiments, taken in conjunction with the drawings.

FIG. *2a*–FIG. *5a*, show the position of the differential piston before an injection;

FIG. *2b*–FIG. *5b* show the position of the piston during the injection;

FIG. *2c*–FIG. *5c* show the position of the piston directly at the end of injection after the opening of the control valve.

DESCRIPTION OF THE PREFERRED EMBODIMENTS

Figure 1:
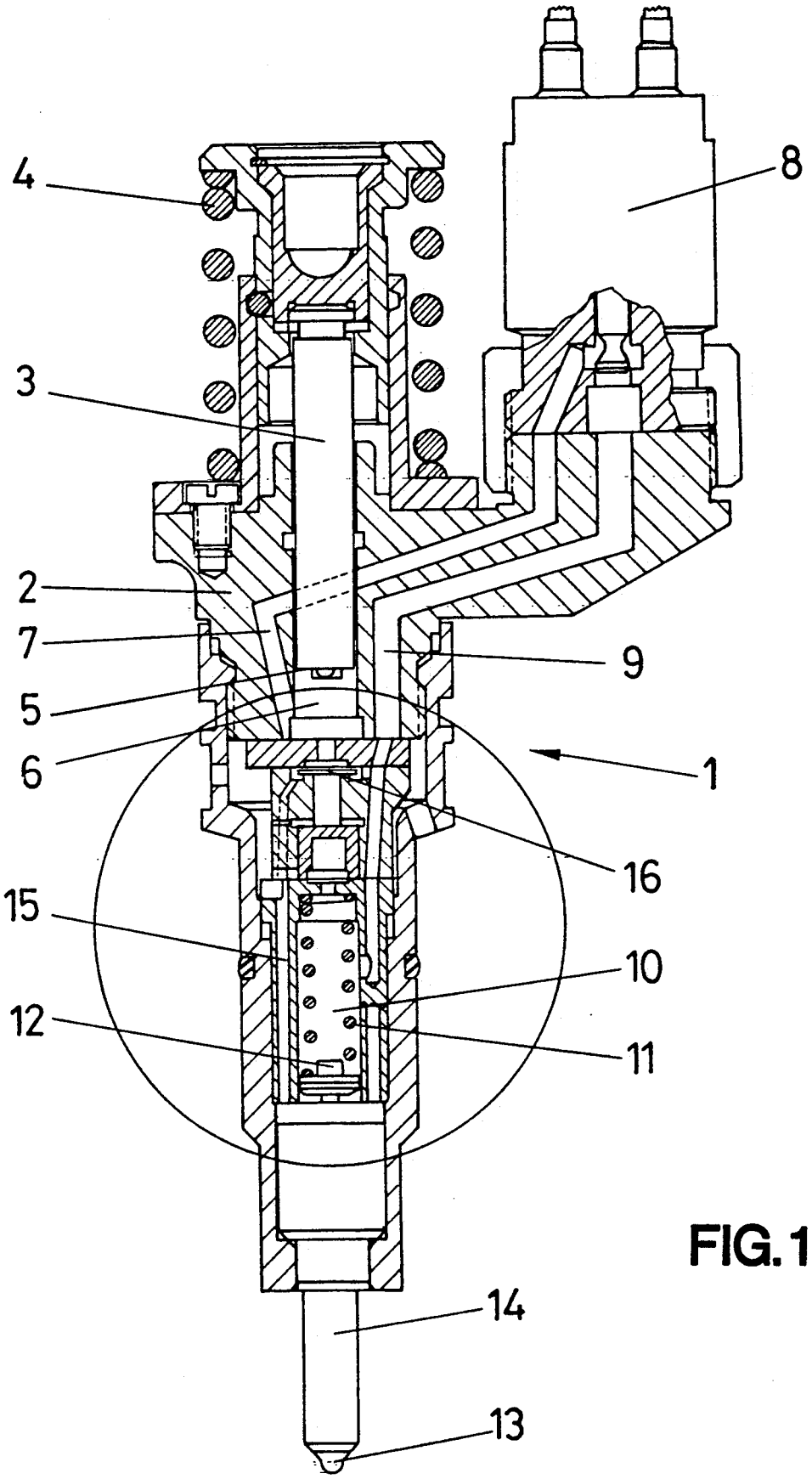
FIG. 1 is a partial cross sectional view through a fuel injection device, in particular a unit fuel injector, according to the invention; and FIGS. *2a*, *2b*, *2c*, *3a*, *3b*, *3c*, *4a*, *4b*, *4c* and FIGS. *5a*, *5b*, *5c*, on a larger scale, are sections through the portion circled in FIG. 1 for various embodiments of the fuel injection device according to the invention, with the actuating . element of the valve closing toward the pump work chamber embodied as a differential piston.

FIG. 1 shows a unit fuel injector 1, in the housing 2 of which a pump piston 3, which is acted upon by a spring 4, is set into reciprocating pumping motion by a drive cam, not shown in detail. With its face end 5 and a bore in the housing, the pump piston 3 defines a pump work chamber 6 which receives fuel from a well known fuel pump connected with a fuel supply, not shown. Adjoining this pump work chamber 6 is a line 7, which leads to a control valve 8 embodied as a magnetic valve; in the open position of the magnetic valve 8, fuel is then carried via a line 9 into a spring chamber 10, in which a spring 11 is placed for acting on an upper end of a nozzle needle 12, as will be described in greater detail below in conjunction with the other drawing figures. From the spring chamber 10, the fuel passes through a bore 17 to reach a return line 20 or is directed to flow back into the suction line of the fuel pump, not shown.

Also adjoining the pump work chamber 6 is a line 15, leading to the nozzle openings 13 of the injection nozzle 14, and this line is closable by a valve generally identified by reference numeral 16.

In the view of the parts essential to the invention shown in FIG. *2a*–FIG. *2c* for a first embodiment, the reference numerals are the same as for FIG. 1. In the position shown in FIG. *2a*, fuel flows out of the pump work chamber 6 via the magnetic valve 8, shown in FIG. 1, back into the line 9 and via line 9 into the nozzle needle spring chamber 10. As the process continues, fuel flows via a connecting bore 17 to one end face 18 of an actuating element, embodied as a differential piston 19 having a large diameter portion 19*a* and a smaller diameter portion 19*b*, of the pressure valve 16 having a closure element 21 between the pump work chamber 6 and the supply line or injection line 15 which is controlled by the differential piston 19. In the position shown, after acting upon the end face 18 of differential piston 19, the fuel reaches a return line 20. In this position, by the action on the end face 18, the valve 16 is retained in its closed position, and the closing force of the nozzle needle spring 11 is further reinforced to keep the nozzle needle 12 in a closed position. The valve closing element 21 of the valve 16 is embodied as a plate-like valve closing element which cooperates with a valve seat having a flat seat face 22 to prevent fuel flow from the work chamber 6 via bore 100.

In the position during the injection event shown in FIG. *2b*, after a closure of the magnetic valve 8 to prevent flow of fuel into line 9 and hence a interruption of fuel delivery into the nozzle needle spring chamber 10 via the line 9, or against the edge face 18, acting in the closing direction of valve 16, of the differential piston 19, fuel flows from work chamber 6 at high pressure after the uncovering of the flow opening by valve 16 and into the injection line 15 to the injection nozzle which applies an opening pressure on the injection nozzle needle 12, and thus, once the nozzle needle 12 lifts from its seat counter to the force of the nozzle needle spring 11, effects an injection for the duration of the closure of the magnetic valve. In that case, the return line 20 is completely closed by the face 18, acted in the closing direction, of the differential piston 19.

Figure 2C:
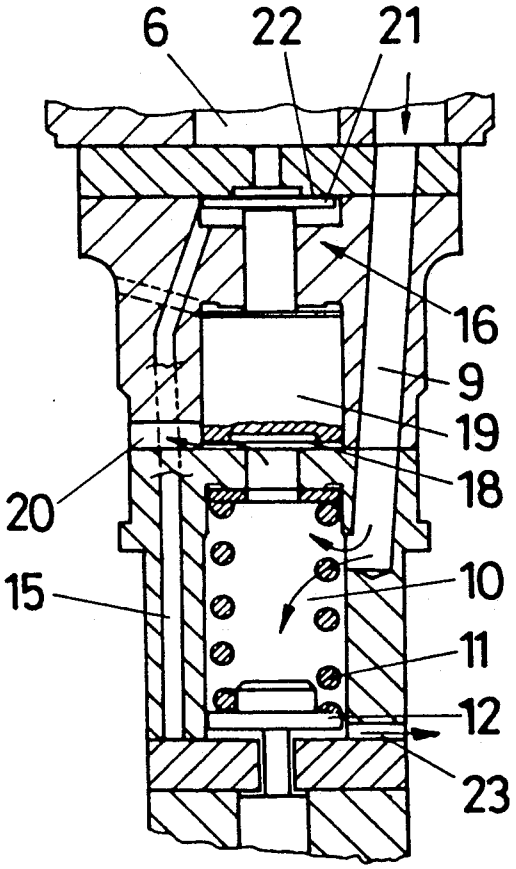

In FIG. 2c, conditions immediately after the opening of the magnetic valve 8 end the injection, are shown. Here, fuel flows at high pressure out of the pump work chamber 6 via line 7, magnetic valve 8 and line 9 into the nozzle needle spring chamber 10, and against the end face 18 of the differential piston 19; because the end face 18, having a diameter D, has a larger effective surface area than the effective fuel pressure surface area on the fuel pressure face of the plate-like valve closing member of diameter d that is acted upon by the fuel, a rapid closing movement of the valve 16 is initiated, as a result of which further feeding of fuel into the injection line 15 is interrupted and further injection is ended immediately. In addition to the fast closure of the valve 16 between the pump work chamber 6 and the injection line 15 for interrupting further fuel feeding to the nozzle needle, the closing motion of the nozzle needle 12 is likewise reinforced via the fuel delivered at high pressure via the line 9 against the end face of the nozzle needle, so that a force in the closing direction of the nozzle needle 12 that exceeds the spring force of the nozzle needle spring 11 become operative. An optional additional return line 23 may be provided, although with an appropriate stroke of the differential piston 19 and hence an uncovering of an appropriate outflow cross section of return 20, this additional return bore can be dispensed with.

The actuating element of the valve 16, embodied as a differential piston 19, may be in one piece, with different piston diameters.

Figure 3C:
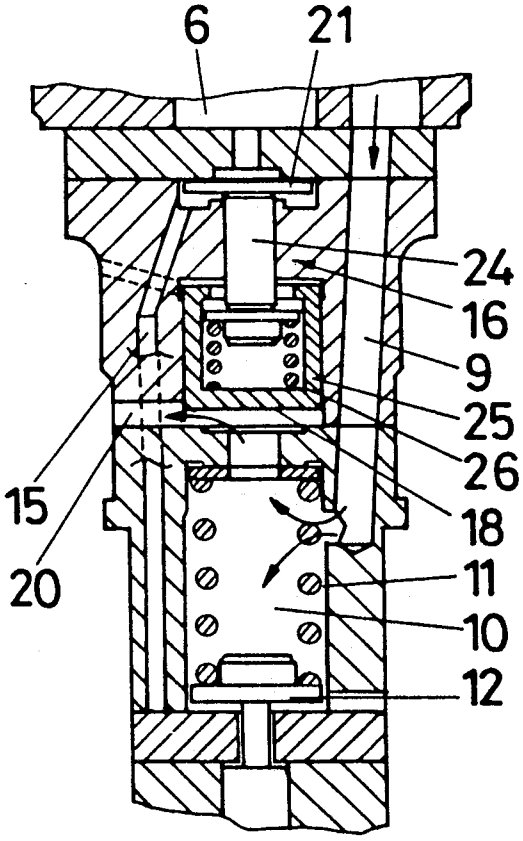
Figure 3B:
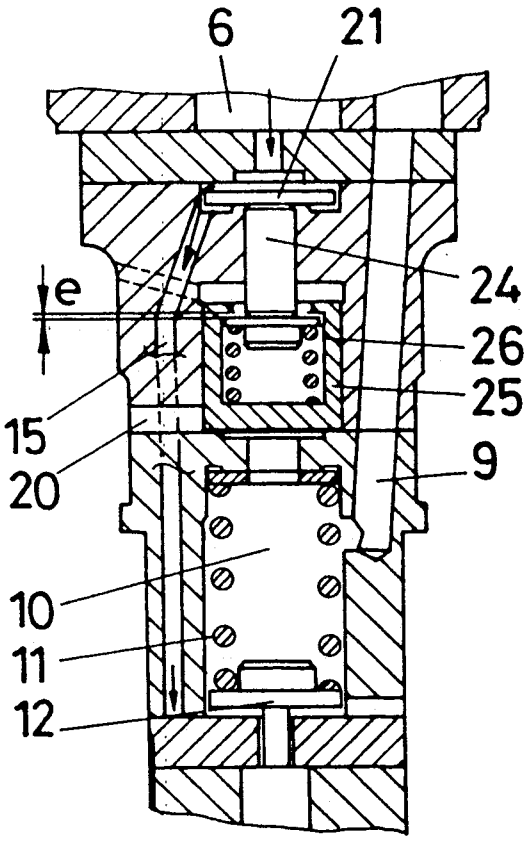
Figure 3A:
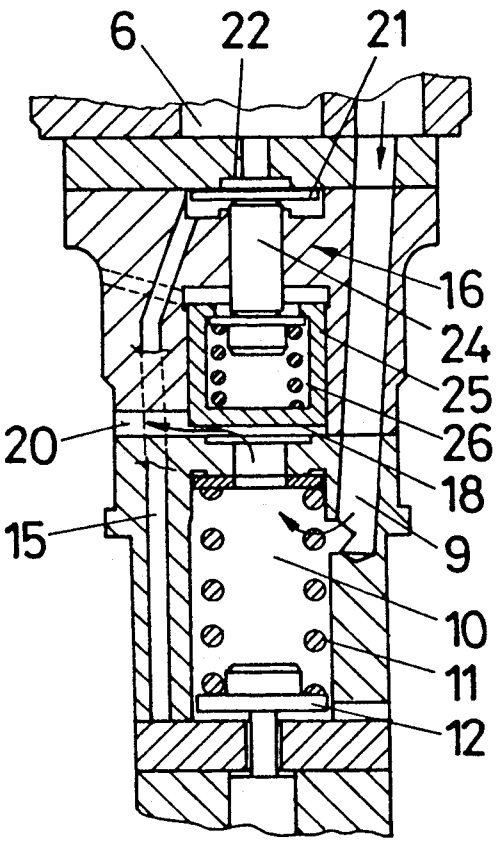

In the embodiment shown in FIG. 3a–FIG. 3c, a differential piston composed of two piston parts 24 and 25 is used, with the piston 24 having the smaller diameter cooperating with the second piston part 25, which is hollow and has the larger diameter, by means of a compression spring 26 disposed in the interior of this second piston 25.

Figure 2B:
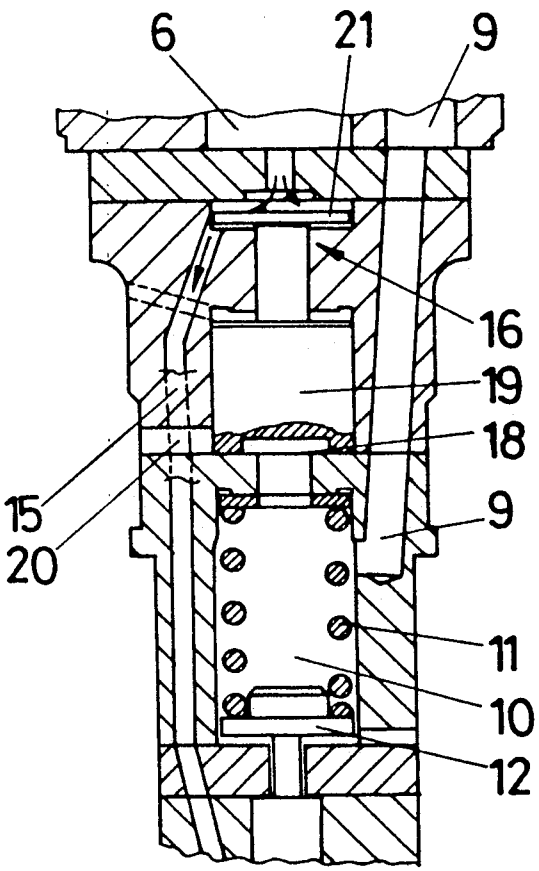
Figure 2A:
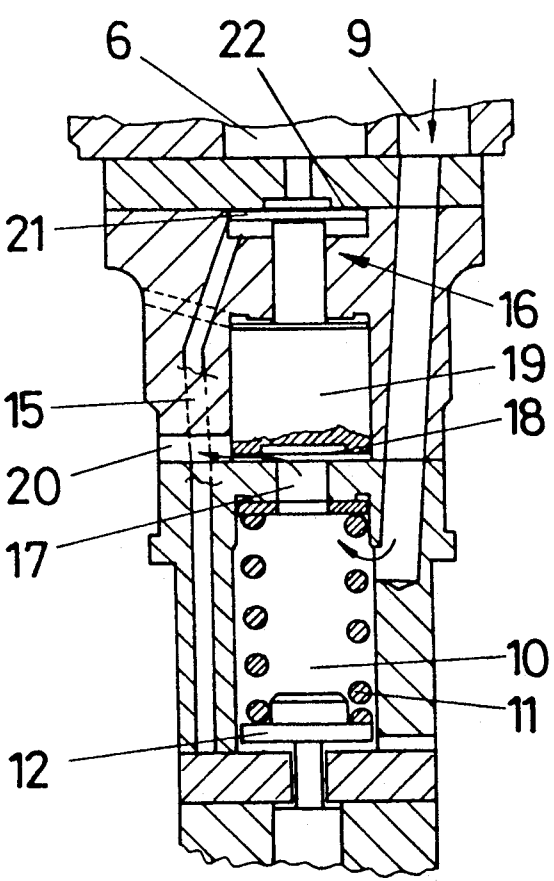

The mode of operation of the embodiment shown in FIGS. 3a–3c is similar to that described above. While the magnetic valve is opened as shown in FIG. 3a, action is again exerted on the end face 18 of the larger piston 25 via the line 9, and thus a closure of the valve 16 is brought about via the plate-like closing element 21. During the injection event, shown in FIG. 3b, the compression spring 26 is compressed slightly, as indicated by the travel difference e and the return line 20 is closed. In the position shown in FIG. 3c, immediately following the opening of the magnetic valve 8, action is again exerted on the end face 18 in the closing direction of the valve 16 via the two-part differential piston 24 and 25, and briefly after the closure of the valve closing element 21 an additional stroke motion of the piston 25 having the larger diameter takes place counter to the force of the spring 26, thus uncovering a larger relief cross section in the return line 20. The compreession spring 26 is designed such that at low speed or low rpm, the two pistons 24 and 25 cooperate similarly to the rigid embodiment of FIG. 2, while at high speeds or high rpm, an increased amount of the ouflow cross section into the return line 20 is uncovered, as shown in FIG. 3c. The opening and closing characteristic can thus be varied by means of the selected rigidity of the spring 26.

Figure 4C:
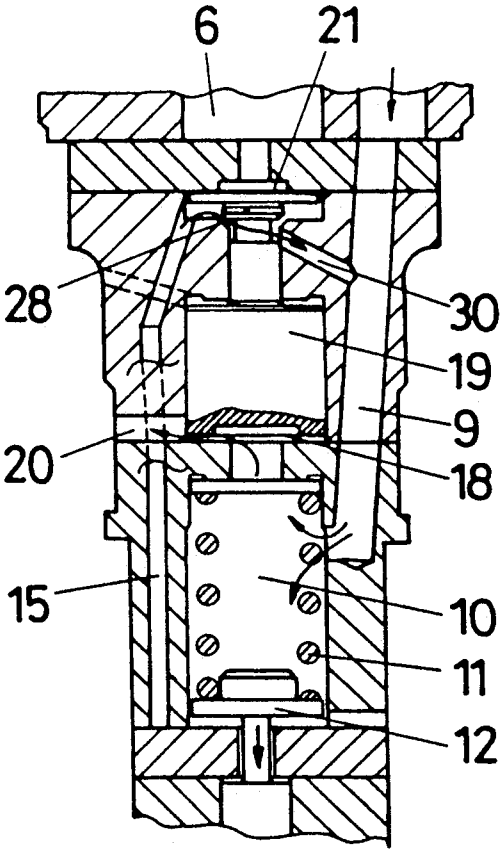
Figure 4B:
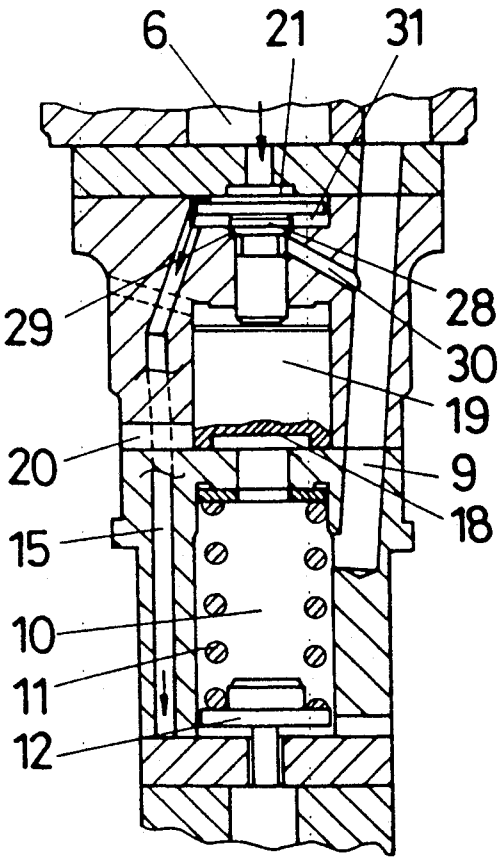
Figure 4A:
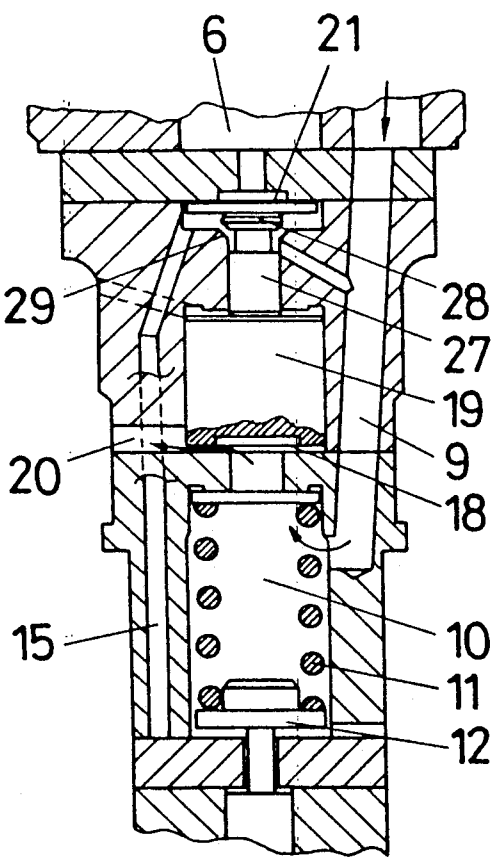

In the embodiment of FIGS. 4a–4c, a differential piston 19 similar to the embodiment of FIG. 2 is used, which once again may be in one piece. In this embodiment, the portion 27 of the differential piston having the smaller diameter has not only the plate-like closing element 21, which closes off the communication between the pump work chamber 6 and the injection line 15, but also a further closing element 28, which cooperates with a valve seat 29 on a bore in the housing into which the portion 27 extends. In the open state of the valve 16, or in other words during an injection, as shown in FIG. 4b, this further valve closing element 28 closes a branch line 30 between the space 31 in which the valve closing element 21 is movable or into which it plunges, and the line 9 connecting the nozzle needle spring chamber 10 with the magnetic valve. At the end of injection shown in FIG. 4c, in addition to the closing motion of the valve 16 in response to the action of fuel at high pressure on the end face 18 o the differential piston 19 via the line 9, the relief of the injection line 15, likewise into the line 9, via the branch line 30 also takes place, after the opening of the additional closing element 28; as a result, among other effects, the closing motion of the nozzle needle 12 is accelerated by a faster reduction of pressure in the injection line 15.

Figure 5C:
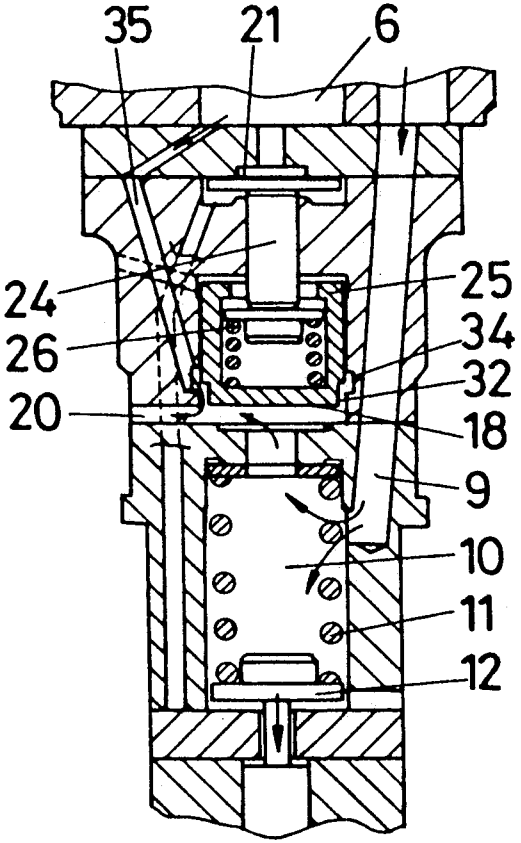
Figure 5B:
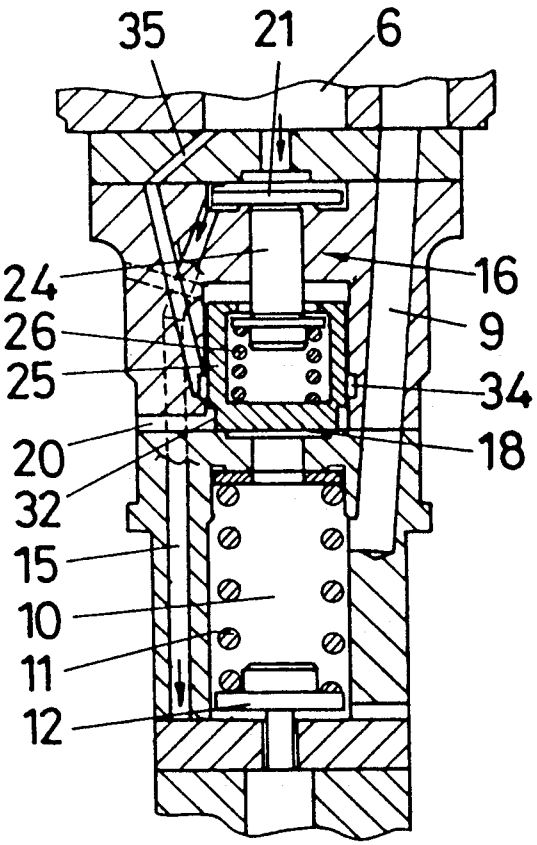
Figure 5A:
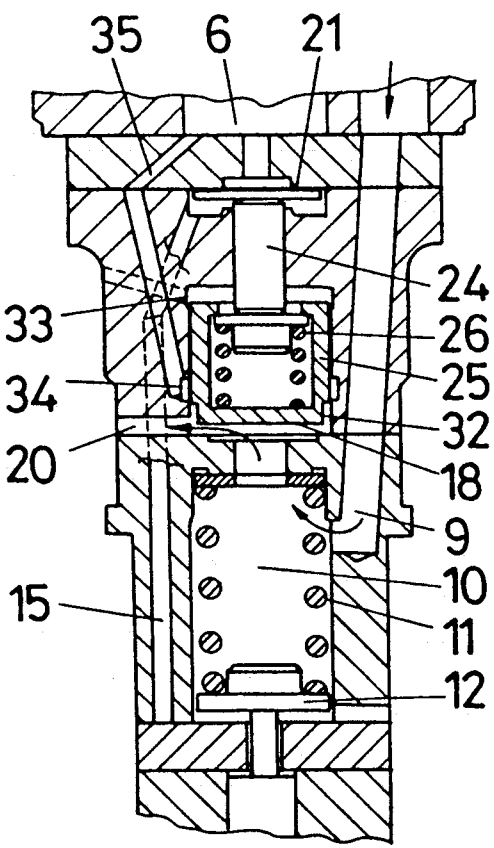

In the embodiment of FIGS. 5a–5c, a differential piston comprising two parts 24 and 25 is again used, the two pistons being braced against one another by the compression spring 26. Immediately adjoinging the end face 18 acted upon in the closing direction, the piston 25 having the larger diameter has a circumferential groove or shoulder zone 32, which is dimensioned such that between two injection events, as shown in FIG. 5a, an annular groove 34 provided in the guide bore 33 and communicating directly with the pump work chamber 6 via a branch line 35 is closed. The mode of operation shown in FIGS. 5a and 5b is equivalent to that of the embodiments described above.

Immediately after the opening of the magnetic valve 8, that is, at the end of an injection event, as shown in FIG. 5c, not only is action exerted on the nozzle needle 12 and on the face end 18 of the differential piston, so that a closure of the plate-like closing element 21 of the valve 16 occurs, similarly to what happens in the embodiment of FIG. 3c, but also a compression of the spring 26 is effected, as a result of which the annular groove 34 is partly uncovered by the shoulder portion 32 of the piston 25, and thus a direct relief of the pump work chamber 6, which is at high pressure, into the return line 20 is effected, with the overall result of a improved closing characteristic of the valve 16.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection device having a housing (2), a fuel pump piston (3) in a bore in said housing, a pump work chamber (6) formed by an end of said fuel pump piston (3) and said housing, a fuel injection line (15) connected to said pump work chamber and communicating with an injection nozzle (13) via an interposed closing valve (16) having a valve closing element (21) operative toward the pump work chamber and an actuating element (19), a magnetic control valve (8) connected to said pump work chamber via a first pressure line (7) to control injection, said pump work chamber being connected with a relief line (9) which supplies fuel under pressure to one side of said actuating element (19) remote from the pump work chamber of said closing valve that closes toward said pump work chamber, a fuel return connecting line (20), said fuel connecting return line being opened and closed by said actuating element (19), and said actuating element of said closing valve (16) is embodied as a differential piston (19, 24, 25), said differential piston includes a first face (18) which urges said closing valve in a closing direction said first face (18) is larger in surface area than an effective surface area of a second face of said closing element subjected to fuel pressure in the opening direction whereby said closing valve (16) is closed by fuel pressure on said first face (18).

2. A fuel injection device as defined by claim 1, in which said closing element of said closing valve (16) is embodied as a plate-shaped closing element.

3. A fuel injection device as defined by claim 1, in which said differential piston comprises two pistons (24, 25), operatively joined together via an interposed compression spring (26).

4. A fuel injection device as defined by claim 2, in which said differential piston comprises two pistons (24, 25), operatively joined together via an interposed compression spring (26).

5. A fuel injection device as defined by claim 1, in which said fuel return connecting line (20) is opened by a part of said differential piston (19, 25) that is urged in a direciton for closing said closing valve (16), and said fuel return connecting line (20) is closed after a predetermined stroke of said differential piston in an opening direction of said closing valve (16).

6. A fuel injection device as defined by claim 2, in which said fuel return connecting line (20) is opened by a part of said differential piston (19, 25) that is urged in a direciton for closing said closing valve (16), and said fuel return connecting line (20) is closed after a predetermined stroke of said differential piston in an opening direction of said closing valve (16).

7. A fuel injection device as defined by claim 3, in which said fuel return connecting line (20) is opened by a part of said differential piston (19, 25) that is urged in a direciton for closing said closing valve (16) and said fuel return connecting line (20) is closed after a predetermined stroke of said differential piston in an opening direction of said closing valve (16).

8. A fuel injection device as defined by claim 4, in which said fuel return connecting line (20) is opened by a part of said differential piston (19, 25) that is urged in a direction for closing said closing valve (16), and said fuel return connecting line (20) is closed after a predetermined stroke of said differential piston in an opening direction of said closing valve (16).

9. A fuel injection device as defined by claim 1, in which at least one portion of said differential piston (19) oriented toward said pump work chamber (6) includes a second closing element (28), which when said closing valve (16) is open closes a branch line (30) between said injection line (15) and said relief line (9) of the control valve (8).

10. A fuel injection device as defined by claim 2, in which at least one portion of said differential piston (19) oriented toward said pump work chamber (6) includes a second closing element (28), which when said closing valve (16) is open closes a branch line (30) between said injection line (15) and said relief line (9) of the control valve (8).

11. A fuel injection device as defined by claim 3, in which at least one portion of said differential piston (19) oriented toward said pump work chamber (6) includes a second closing element (28), which when said closing valve (16) is open closes a branch line (30) between said injection line (15) and said relief line (9) of the control valve (8).

12. A fuel injection device as defined by claim 5, in which at least on portion of said differential piston (19) oriented toward said pump work chamber (6) includes a second closing element (28), which when said closing valve (16) is open closes a branch line (30) between said injection line (15) and said relief line (9) of the control valve (8).

13. A fuel injection device as defined by claim 1, in which said housing includes an annular groove (34) juxtaposed said fuel return connecting line (20) in said housing and a branch line (35) that extends from said fuel work chamber (6) to said annular groove (34), in which said first face (18) of said differential piston (25) during a closing movement of said differential piston (24, 25) uncovers at least a portion of said groove (35) which permits fluid flow from said pump work chamber (6) to said return line (20) thereby bypassing said magnetic control valve (8).

14. A fuel injection device as defined by claim 2, in which said housing includes an annular groove (34) juxtaposed said fuel return connecting line (20) in said housing and a branch line (35) that extends from said fuel work chamber (6) to said annular groove (34), in which said first face (18) of said differential piston (25) during a closing movement of said differential piston (24 25) uncovers at least a portion of said groove (35) which permits fluid flow from said pump work chamber (6) to said return line (20) thereby bypassing said magnetic control valve (8).

15. A fuel injection device as defined by claim 3, in which said housing includes an annular groove (34) juxtaposed said fuel return connecting line (20) in said housing and a branch line (35) that extends from said fuel work chamber (6) to said annular groove (34), in which said first face (18) of said differential piston (25) during a closing movement of said differential piston (24, 25) uncovers at least a portion of said groove (34) which permits fluid flow from said pump work chamber (6) to said return line (20) thereby bypassing said magnetic control valve (8).

16. A fuel injection device as defined by claim 5, in which said housing includes an annular groove (34) juxtaposed said fuel return connecting line (20) in said housing and a branch line (35) that extends from said fuel work chamber (6) to said annular groove (34), in which said first face (18) of said differential piston (25) during a closing movement of said differential piston (24, 25) uncovers at least a portion of said groove (35) which permits fluid flow from said pump work chamber (6) to said return line (20) thereby bypassing said magnetic control valve (8).

17. A fuel injection device as defined by claim 8, in which said housing includes an annular groove (34) juxtaposed said fuel return connecting line (20) in said housing and a branch line (35) that extends from said fuel work chamber (6) to said annular groove (34), in which said first face (18) of said differential piston (25) during a closing movement of said differential piston (24, 25) uncovers at least a portion of said groove (35) which permits fluid flow from said pump work chamber (6) to said return line (20) thereby bypassing said magnetic control valve (8).

18. A fuel injection device as defined by claim 9, in which said housing includes an annular groove (34) juxtaposed said fuel return connecting line (20) in said housing and a branch line (35) that extends from said fuel work chamber (6) to said annular groove (34), in which said first face (18) of said differential piston (25) during a closing movement of said differential piston (24, 25) uncovers at least a portion of said groove (35) which permits fluid flow from said pump work chamber (6) to said return line (20) thereby bypassing said magnetic control valve (8).

19. A fuel injection device as defined by claim 11, in which said housing includes an annular groove (34) juxtaposed said fuel return connecting line (20) in said housing and a branch line (35) that extends from said fuel work chamber (6) to said annular groove (34), in which said first face (18) of said differential piston (25) during a closing movement of said differential piston (24, 25) uncovers at least a portion of said groove (35) which permits fluid flow from said pump work chamber (6) to said return line (20) thereby bypassing said magnetic control valve (8).

20. A fuel injection device as defined by claim 12, in which said housing includes an annular groove (34) juxtaposed said fuel return connecting line (20) in said housing and a branch line (35) that extends from said fuel work chamber (6) to said annular groove (34), in which said first face (18) of said differential piston (25) during a closing movement of said differential piston (24, 25) uncovers at least a portion of said groove (35) which permits fluid flow from said pump work chamber (6) to said return line (20) thereby bypassing said magnetic control valve (8).

* * * * *